US006279571B1

(12) United States Patent
Meckes

(10) Patent No.: US 6,279,571 B1
(45) Date of Patent: Aug. 28, 2001

(54) EMERGENCY BREATHING APPARATUS

(75) Inventor: Rüdiger Meckes, Berkenthin (DE)

(73) Assignee: Dräger Aerospace GmbH, Lübeck (DE)

( * ) Notice: Subject to any disclaimer, the term of this patent is extended or adjusted under 35 U.S.C. 154(b) by 0 days.

(21) Appl. No.: 09/353,012

(22) Filed: Jul. 13, 1999

(30) Foreign Application Priority Data

Jul. 16, 1998 (DE) ..... 198 32 000

(51) Int. Cl.[7] ..... A62B 17/04

(52) U.S. Cl. ..... 128/201.22; 128/201.25; 128/205.28

(58) Field of Search ..... 128/201.22–201.25, 128/201.28, 201.27, 202.13, 202.16, 202.26, 205.22, 205.25, 205.27, 205.28, 205.24, 206.19, 206.26, 207.12, 206.22, 204.24, 204.16

(56) References Cited

U.S. PATENT DOCUMENTS

| | | | | |
|---|---|---|---|---|
| H1360 | * | 10/1994 | Grove et al. | 128/201.25 |
| 3,895,625 | | 7/1975 | Delest . | |
| 4,164,218 | * | 8/1979 | Martin | 128/201.25 |
| 4,221,216 | * | 9/1980 | Kranz | 128/201.23 |
| 4,552,140 | * | 11/1985 | Cowley et al. | 128/201.25 |
| 4,623,520 | * | 11/1986 | Robinet | 128/202.26 |
| 4,836,197 | * | 6/1989 | Rohling et al. | 128/201.23 |
| 4,896,665 | * | 1/1990 | Gervais | 128/201.25 |
| 4,963,327 | * | 10/1990 | Russell | 128/202.26 |
| 5,027,810 | | 7/1991 | Patureau et al. . | |
| 5,113,854 | * | 5/1992 | Dosch et al. | 128/201.23 |
| 5,119,808 | * | 6/1992 | Marquardt et al. | 128/201.22 |
| 5,165,399 | * | 11/1992 | Hochberg | 128/205.12 |
| 5,226,409 | * | 7/1993 | Bower et al. | 128/201.23 |
| 5,452,712 | * | 9/1995 | Richardson | 128/201.25 |
| 5,495,847 | * | 3/1996 | Hu | 128/202.26 |
| 5,566,668 | * | 10/1996 | Hesadanont | 128/201.26 |
| 5,724,958 | * | 3/1998 | Farnworth et al. | 128/201.23 |
| 5,819,728 | * | 10/1998 | Ritchie | 128/201.23 |
| 5,865,175 | * | 2/1999 | Chu | 128/205.22 |
| 6,041,778 | * | 3/2000 | Swann et al. | 128/201.25 |

FOREIGN PATENT DOCUMENTS 0426885 5/1991 (EP) .

* cited by examiner

*Primary Examiner*—John G. Weiss
*Assistant Examiner*—Teena Mitchell
(74) *Attorney, Agent, or Firm*—Walter Ottesen

(57) ABSTRACT

The invention is directed to an emergency hood to be worn by a person in an environment where there is fire or contamination. The hood closes off the head of the person to the ambient and has an elastic, gas-impermeable ruff extending down to the neck and shoulder region of the wearer. The hood has an interior space for accommodating the head of the wearer and is made of a fire resistant gas-impermeable material and has a transparent visor in the region of the eyes or face of the person and the visor likewise is made of fire resistant, gas-impermeable material. An oxygen supply unit supplies oxygen to the hood for use by the person and a water and carbon dioxide absorbing flexible areal absorber unit is mounted in the interior space. The absorber unit has an ejector connected to the oxygen supply unit for discharging the oxygen into the interior space and for moving the respiratory air of the wearer out of the interior space and through the absorber unit whereby respiratory air again enters the interior space with water and carbon dioxide removed therefrom.

8 Claims, 3 Drawing Sheets

EMERGENCY BREATHING APPARATUS

FIELD OF THE INVENTION

The invention relates to an emergency breathing apparatus in the form of a hood for use in an environment where there is fire or contamination.

BACKGROUND OF THE INVENTION

Emergency breathing apparatus of this kind are used in emergency situations in modern transport systems and especially in passenger aircraft, railroads and ships and are intended to protect passengers and crew against the consequences of fire and especially from smoke and gas poisonings.

U.S. Pat. No. 5,027,810 discloses an emergency breathing apparatus incorporating a hood which makes oxygen from a pressurized cylinder available for a time duration of approximately 5 to 10 minutes. The central component of this hood contains the pressurized gas cylinder with oxygen, a labyrinth-like configured flowpath through an absorption material and an ejector directly at the outlet valve of the pressurized gas cylinder.

SUMMARY OF THE INVENTION

It is an object of the invention to provide an emergency breathing apparatus incorporating a hood for use in an environment where there is fire or contamination. It is also an object of the invention to provide such an apparatus which, on the one hand, is compact and easy to carry and, on the other hand, is robust and easy to manipulate.

The emergency hood of the invention is to be worn by a person in an environment where there is fire or contamination. The emergency hood includes: a hood closing off the head of the person to the ambient and the hood having an elastic, gas-impermeable ruff extending down to the neck and shoulder region of the wearer; the hood defining an interior space for accommodating the head of the wearer and being made of a fire resistant gas-impermeable material and having a transparent visor in the region of the eyes or face of the person and the visor likewise being made of fire resistant, gas-impermeable material; an oxygen supply unit for supplying oxygen to the hood for use by the person; a water and carbon dioxide absorbing flexible areal absorber unit mounted in the interior space; and, the absorber unit having an ejector connected to the oxygen supply unit for discharging the oxygen into the interior space and for moving the respiratory air of the wearer out of the interior space and through the absorber unit whereby respiratory air again enters the interior space with water and carbon dioxide removed therefrom.

The essential advantage of the invention compared to the emergency breathing apparatus of the state of the art results from the areal flexible configuration of the absorber element in combination with the conduction of the gas via the ejector from a separate oxygen supply into the interior of the hood, on the one hand, and from the interior space of the hood via the ejector into the absorber element, on the other hand.

BRIEF DESCRIPTION OF THE DRAWINGS

The invention will now be described with reference to the drawings wherein.

DESCRIPTION OF THE PREFERRED EMBODIMENTS OF THE INVENTION

Figure 1A:
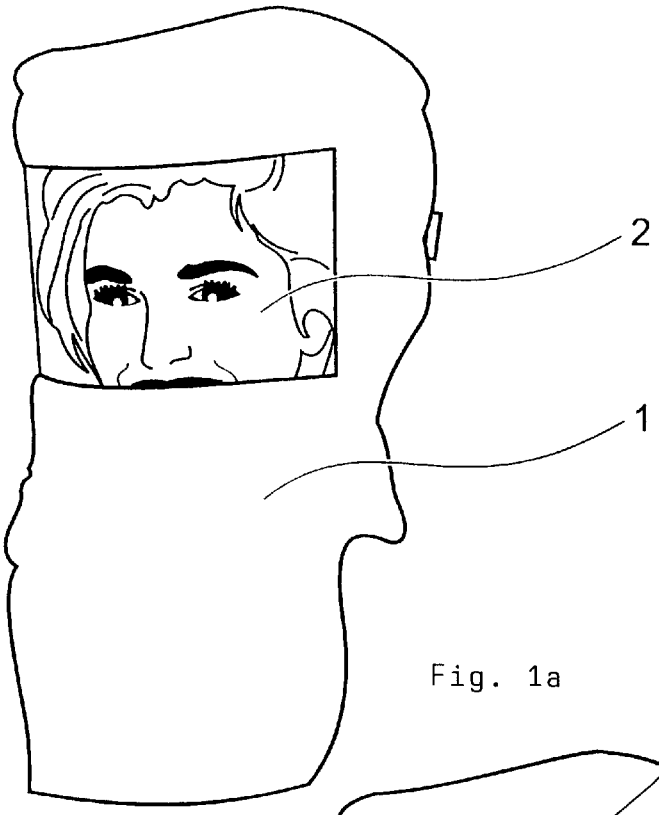
FIG. 1*a* is a perspective view of a first embodiment of the invention of the hood worn by a person.
Figure 1B:
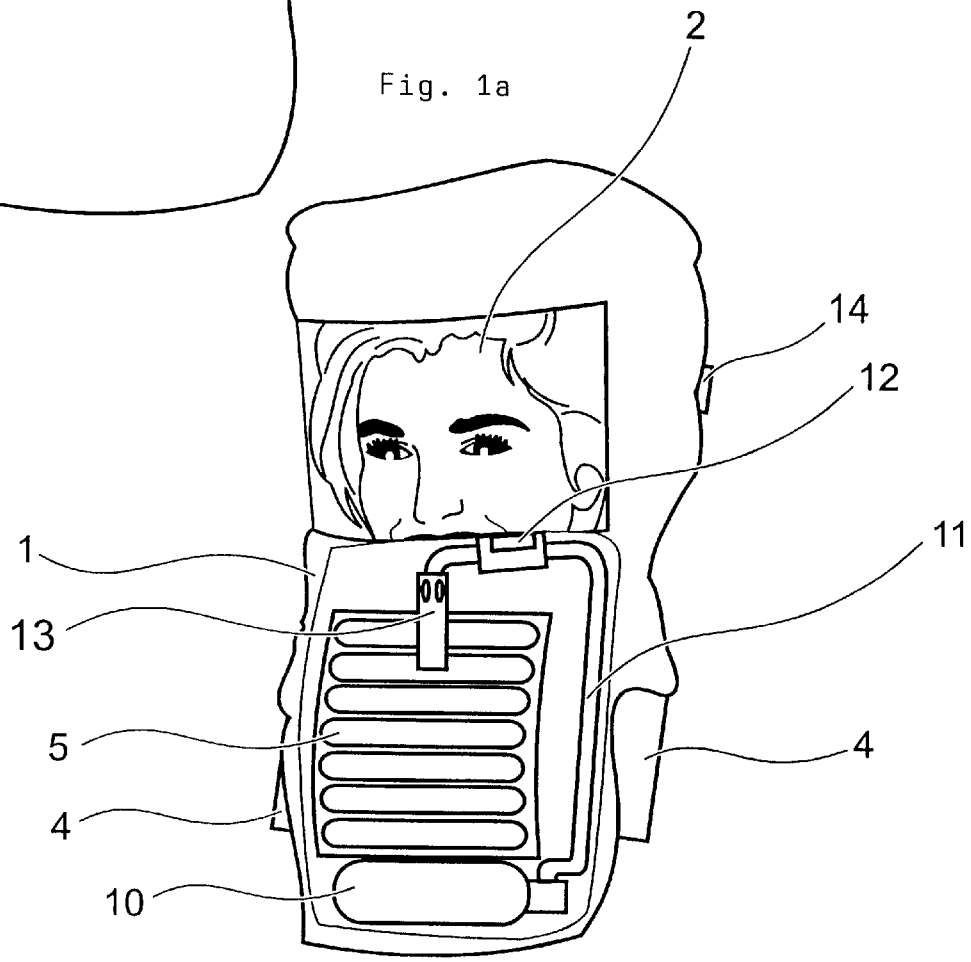
FIG. 1*b* is a perspective view with the front wall broken away to show the absorber element within the hood.

The hood 1 shown in FIGS. 1*a* and 1*b* is a fire emergency hood which is used for fighting fire and for escaping from rooms where fire is present or from rooms contaminated, for example, with toxic gases.

A hood of this kind is, as a rule, made of a fireproof material impermeable to gas in order to make the use thereof or the escape with the hood possible at least for a predetermined time.

The material of the hood 1 is typically a fiber-glass fabric which is coated on the outer side with polyurethane or TEFLON and is coated on the inner side with silicone rubber. Alternatively, the material of the hood 1 can be a polyimide material such as a material available in the marketplace under the trade name "KAPTON".

In the hood 1, a window is cut into the forward side and a fireproof transparent visor 2 is introduced which is impermeable to gas. The visor is made of a transparent plastic having an outer coating of TEFLON or cellulose propionate. The internal side of the visor is provided with an anti-fog coating. The gas-tight closure of the head with respect to the ambient is provided by an elastic gas-impermeable ruff 3 made of silicone rubber which, if necessary, is provided with an additional coating of polyurethane. The ruff 3 is attached on the inner side of the hood to the material of the hood 1 and this attachment is impermeable to gas.

The ruff 3 has an opening in the center thereof through which the wearer of the hood passes the head when placing the same thereon. Two handles 4 are provided on the right and left sides to facilitate placing the hood on the head.

Figure 2:
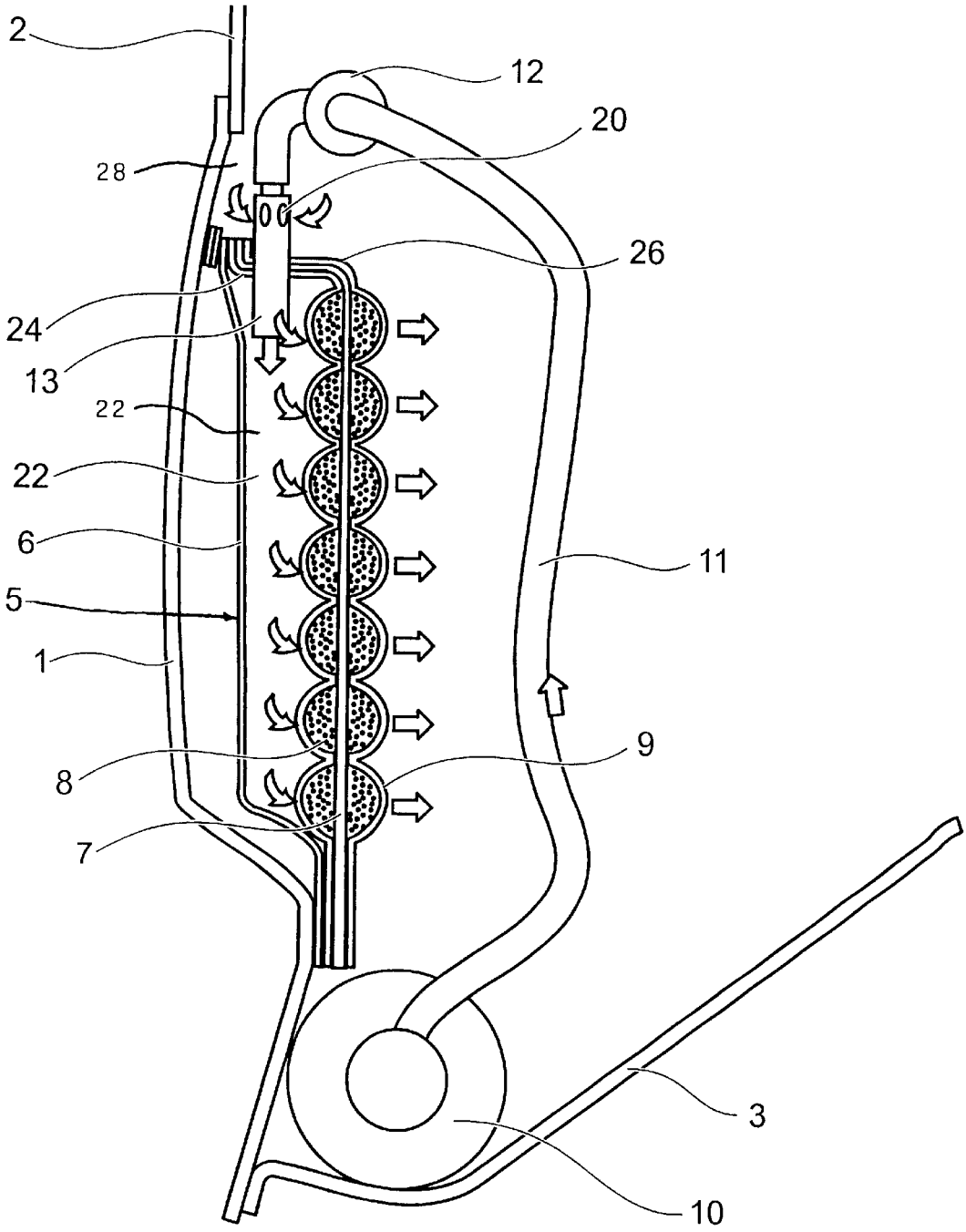
FIG. 2 is a side elevation view, in section, taken through the absorber element shown in FIG. 1*b;*

The carbon dioxide which develops with the breathing of the wearer of the hood is absorbed by an areal or large surface flexible pillow-like absorber unit 5. The special configuration of the absorber unit 5 will now be explained with respect to FIG. 2.

Three gas-permeable nonwoven fabrics 7 or woven fabrics of cellulose or plastic are divided by a plurality of seams into chambers (8, 9). The nonwoven fabrics or woven fabrics are provided with a dust-rejecting coating at least on the inlet and outlet sides of the respiratory air. The chambers 8 are mounted forward of the chambers 9 when viewed in the gas flow direction (indicated by the arrows) and are filled with water-absorbing chemicals such as silica gel and/or zeolite. On the other hand, the chambers 9 are mounted downstream of the chambers 8 when viewed in the direction of the gas flow and are filled with carbon dioxide absorbing chemicals such as lithium hydroxide, sodium hydroxide and/or potassium dioxide.

A gas-impermeable foil 6 together with the nonwoven fabrics 7 (or woven fabric) conjointly define an enclosed space 22 in which respiratory air is drawn in from the interior space 28 of the hood via an ejector 13. The respiratory air then flows through the nonwoven fabrics 7 and through the chambers (8, 9) filled with the chemicals and then back into the interior space 28 of the hood.

The oxygen, which is necessary for breathing and for the metabolism of the hood wearer, is supplied from a pressurized gas cylinder 10 having a constant-flow controller. The oxygen flows via a gas line 11 and via a through-flow indicator 12 into the ejector 13. The ejector 13 is mounted seal-tight at 24 in wall 26 of the absorber unit 5. The gas line 11 is especially in the form of a flexible hose made of plastic and the through-flow indicator 12 is mounted in the field of view of the wearer of the hood. The ejector 13 inducts respiratory air from the interior space 28 of the hood and moves the same into the absorber unit 5 while injecting the oxygen also into the absorber element (indicated by the arrows).

More specifically, and with respect to the injector 13, the oxygen flow from vessel 10 produces a partial vacuum causing the exhaled respiratory air in the interior space 28 to be conducted through the apertures 20 and discharged into the enclosed space 22 of the absorber unit 5. Thus, the oxygen and the respiratory air are both passed through the absorber unit 5 as indicated by the arrows.

The emergency hood 1 has a hood volume of approximately six liters because, at the same time, it should serve as a breathing bag having a reservoir of respiratory gas.

A pressure limiting valve 14 is mounted between the interior space of hood and the ambient so that the pressure in the hood 1 in normal operation and especially for a decompression (for example, in aircraft) is limited to a physiologically allowable amount. The pressure limiting valve 14 is mounted at the rearward side of the hood and releases overpressure to the ambient at approximately 1.5 mbar.

Figure 3A:
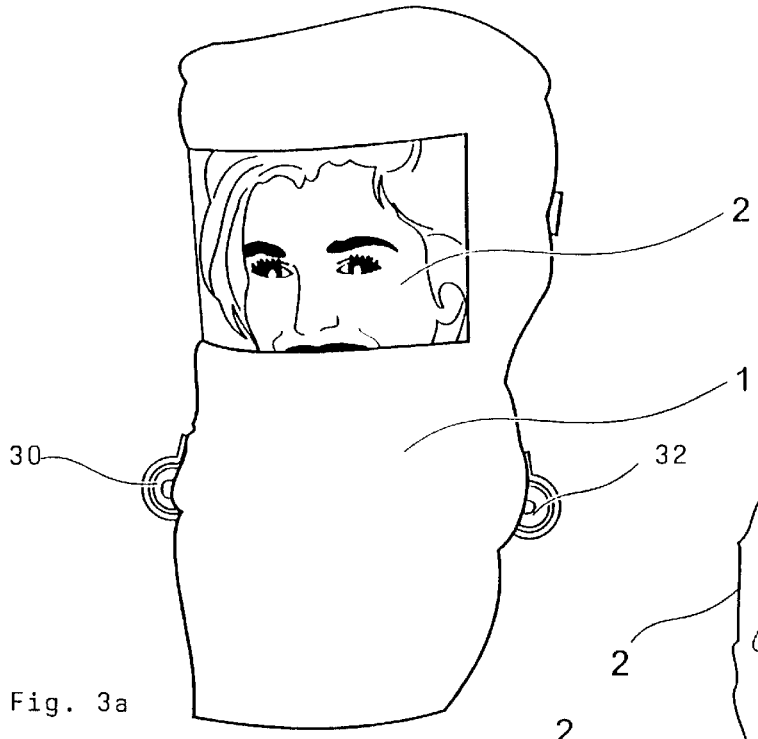
FIG. 3*a* is a perspective view of a second embodiment of the invention of the hood having two oxygen generators.
Figure 3C:
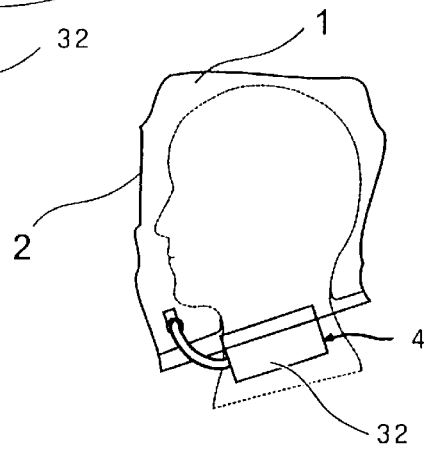
FIG. 3*b* is a perspective view with the front wall broken away to show the absorber element and the two gas lines connecting the absorber element to respective oxygen generators; and, FIG. 3*c* is a side elevation view of the hood shown in FIGS. 3*a* and 3*b*.
Figure 3B:
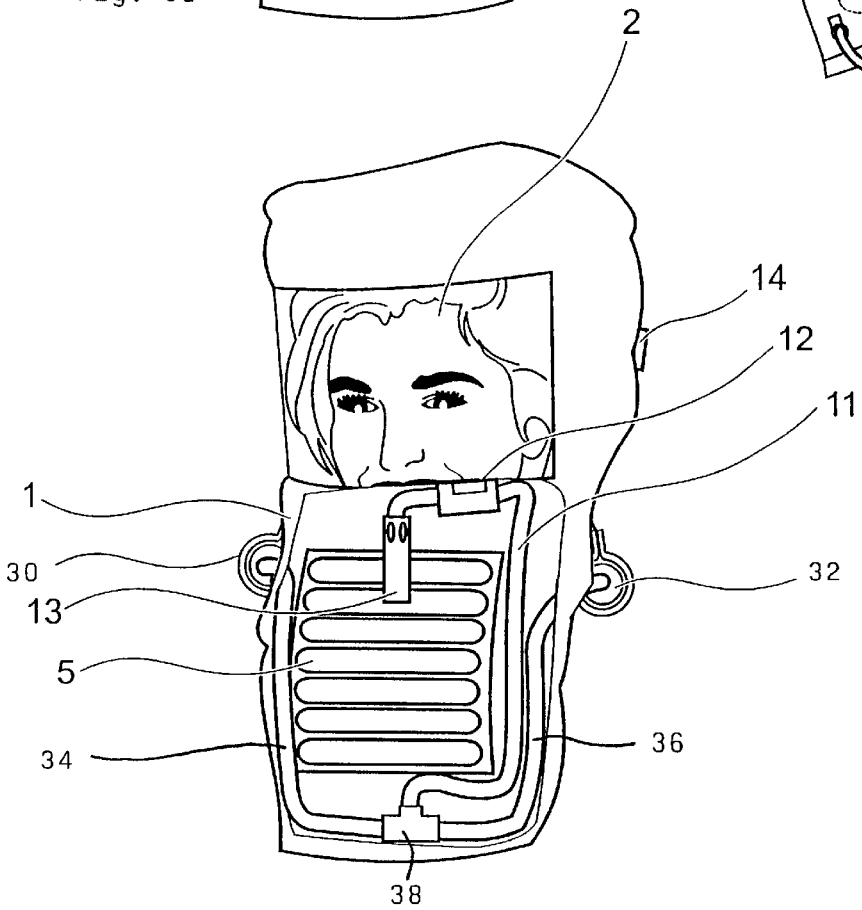

An alternate embodiment of the invention is shown in FIGS. 3*a* to 3*c*. In this embodiment, two chemical oxygen generators 30 and 32, which are well insulated thermally, can be provided as an oxygen supply in order to drive the ejector 13. The chemical oxygen generators (30, 32) are integrated into handles 4 and serve as handles for the wearer when placing the hood 1 on the head.

As shown in FIG. 3*b*, the oxygen generators (30, 32) are connected via respective gas lines (34, 36) to a T section 38 which, in turn, is connected to the ejector 13 via a gas line 11.

It is understood that the foregoing description is that of the preferred embodiments of the invention and that various changes and modifications may be made thereto without departing from the spirit and scope of the invention as defined in the appended claims.

What is claimed is:

1. An emergency hood to be worn by a person in an environment where there is fire or contamination, the emergency hood comprising:

a hood closing off a head of a person to the ambient and said hood having an elastic, gas-impermeable ruff extending down to the neck and shoulder region of the wearer;

said hood defining an interior space for accommodating a head of a wearer and being made of a fire resistant gas-impermeable material and having a transparent visor in the region of the eyes or face of a person and said visor likewise being made of fire resistant, gas-impermeable material;

an oxygen supply unit for supplying oxygen to said hood for use by a person;

a water and carbon dioxide absorbing flexible areal absorber unit mounted in said interior space;

said absorber unit having an ejector connected to said oxygen supply unit for discharging the oxygen into said interior space and for moving respiratory air of a wearer out of said interior space and through said absorber unit whereby respiratory air again enters said interior space with water and carbon dioxide removed therefrom; and, said absorber unit including: fabric means configured to define a first plurality of first chambers and a second plurality of second chambers downstream of said first chambers, respectively; a gas-permeable fabric for separating said first chambers from said second chambers, respectively; and, each of said first chambers containing a water absorbing chemical and each of said second chambers containing a carbon dioxide absorbing chemical.

2. The emergency hood of claim 1, said hood having first and second handles on opposite sides thereof.

3. The emergency hood of claim 2, wherein said oxygen supply unit is a pressurized gas cylinder.

4. The emergency hood of claim 2, wherein said oxygen supply unit is an oxygen generator.

5. The emergency hood of claim 2, said oxygen supply unit being a first oxygen generator connected to said ejector and said emergency hood further comprising a second oxygen generator likewise connected to said ejector; and, said first and second oxygen generators being integrated into said first and second handles, respectively.

6. The emergency hood of claim 1, further comprising a pressure limiting valve disposed between said interior space and said ambient.

7. The emergency hood of claim 6, wherein said pressure limiting valve has a limit pressure of approximately 1.5 mbar relative to the ambient.

8. The emergency hood of claim 1, said first chemical comprising at least one of silica gel and zeolite; and, said second chemical comprising at least one of lithium hydroxide, sodium hydroxide and potassium dioxide.

* * * * *